United States Patent [19]

Johnson et al.

[11] Patent Number: 4,621,566

[45] Date of Patent: Nov. 11, 1986

[54] ELECTRIC PUMP

[75] Inventors: J. Wallace Johnson, Porter; Lewis C. LoMaglio, Kingwood, both of Tex.

[73] Assignee: Liquid Level Lectronics, Inc., Porter, Tex.

[21] Appl. No.: 789,155

[22] Filed: Oct. 18, 1985

Related U.S. Application Data

[63] Continuation-in-part of Ser. No. 777,709, Sep. 11, 1985.

[51] Int. Cl.[4] ..... F04B 39/14; F04B 49/00

[52] U.S. Cl. ..... 92/13.4; 92/128; 417/454

[58] Field of Search ..... 92/60.5, 13.4, 128, 92/13.41, 13.8; 417/274, 499, 454

[56] References Cited

U.S. PATENT DOCUMENTS

| | | | |
|---|---|---|---|
| 1,932,921 | 10/1933 | Bizzari | 417/274 |
| 2,128,140 | 8/1938 | Green | 417/499 |
| 2,337,510 | 12/1943 | Trevaskis | 97/60.5 |
| 2,980,024 | 4/1961 | Pope | 92/13.8 |
| 3,092,037 | 6/1963 | Rhodes | 417/273 |
| 3,229,640 | 1/1966 | Williams | 417/499 |
| 3,257,952 | 6/1966 | McCormick | 92/60.5 |
| 3,375,972 | 4/1968 | Rauifeisen | 92/60.5 |
| 3,527,547 | 9/1970 | Dieter | 417/273 |
| 3,689,199 | 9/1972 | Bassinger | 92/60.5 |
| 3,841,796 | 10/1974 | Schlanzky | 417/274 |
| 3,910,727 | 10/1975 | Flynn | 417/499 |

*Primary Examiner*—William L. Freeh

*Attorney, Agent, or Firm*—Robert W. B. Dickerson

[57] ABSTRACT

An electrically operated injection pump having an eccentrically mounted cam for reciprocating a spring-biased plunger, said plunger causing the receiving of injection fluid during intake stroke, and the ejection of such fluid during the exhaust stroke.

2 Claims, 24 Drawing Figures

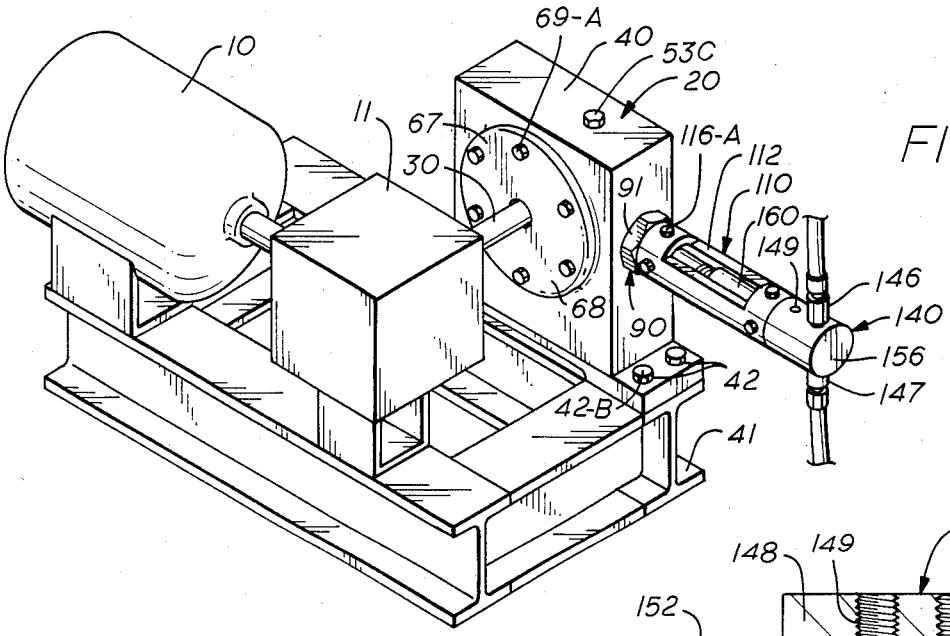
FIG. 1
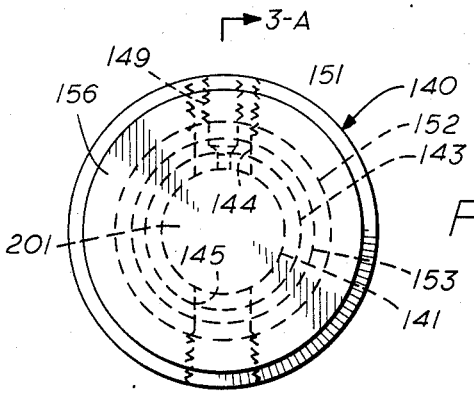
FIG. 3
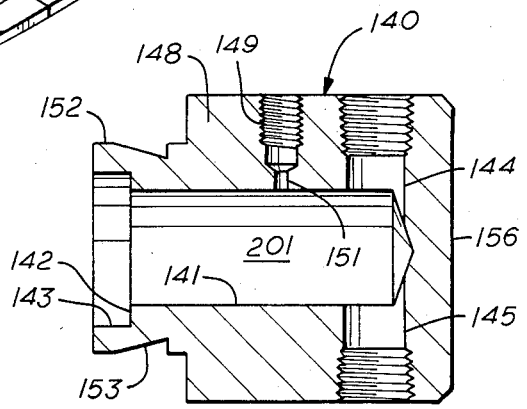
FIG. 3-A
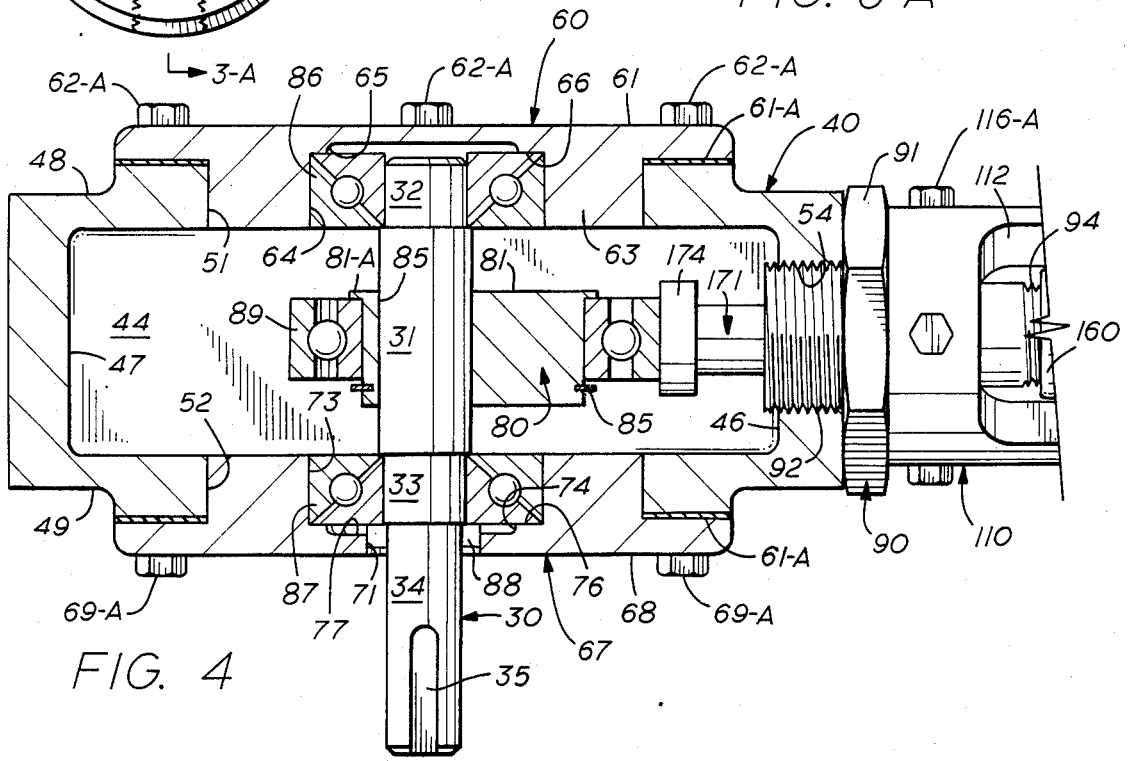
FIG. 4

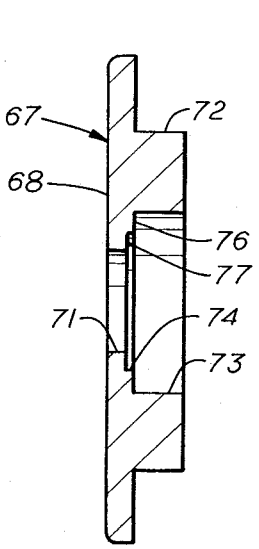
FIG. 8-B
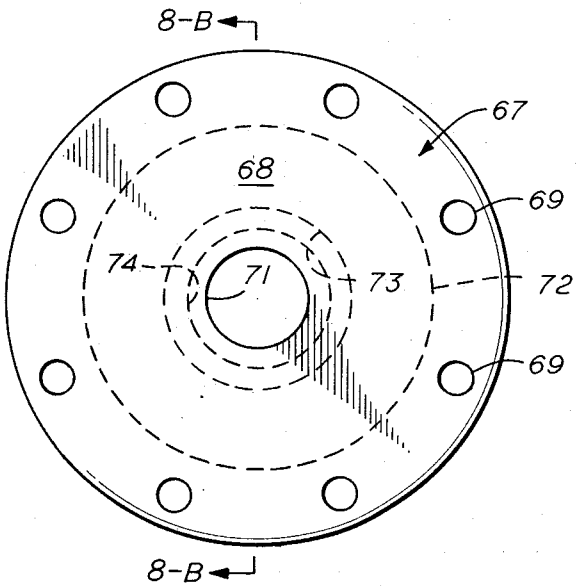
FIG. 8-A
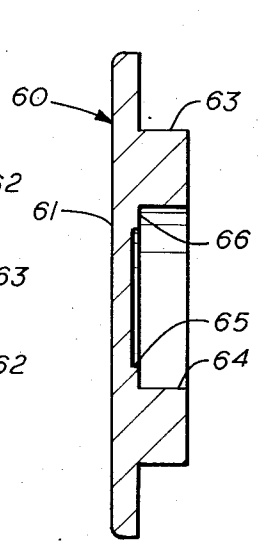
FIG. 7-B
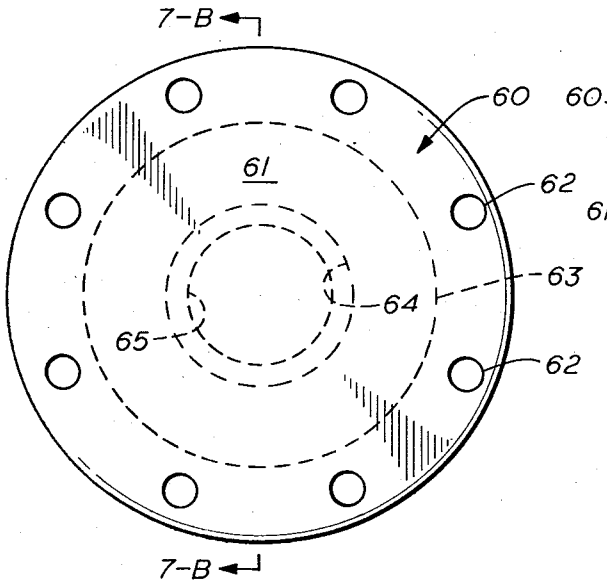
FIG 7-A
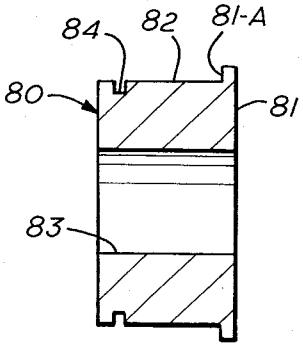
FIG 10-A
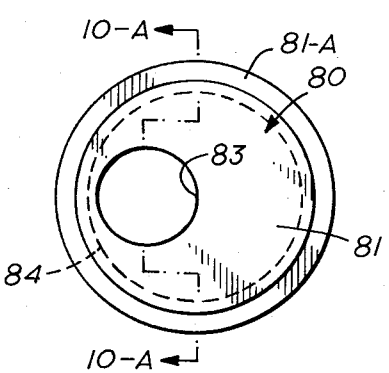
FIG. 10
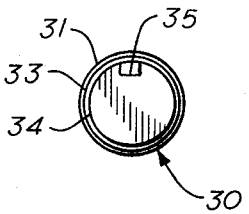
FIG. 9-A
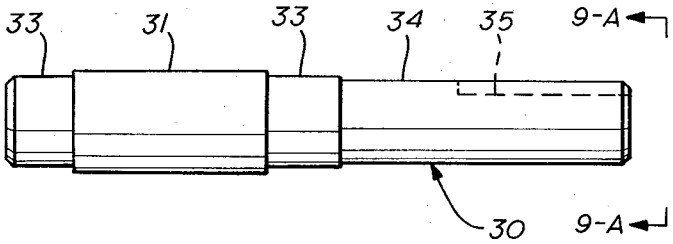
FIG. 9

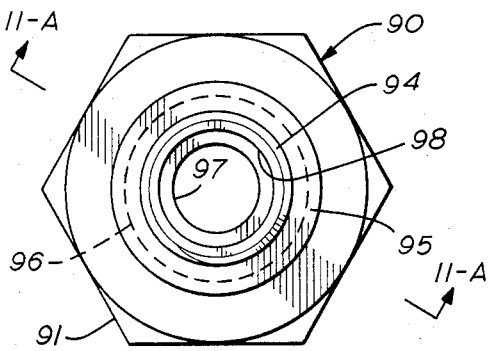
FIG. 11
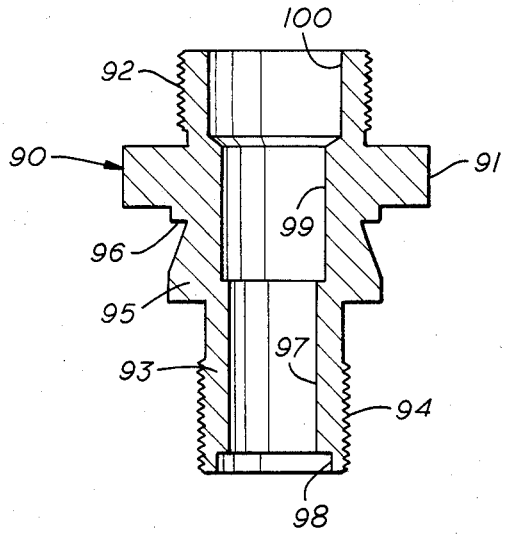
FIG. 11-A
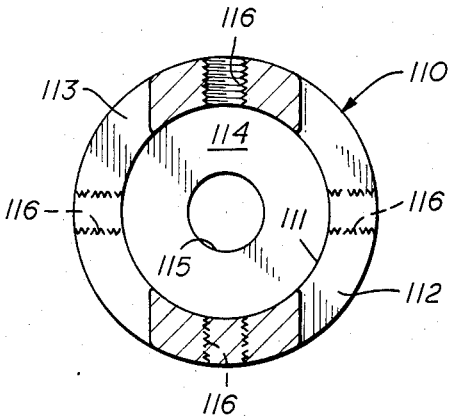
FIG. 12-A
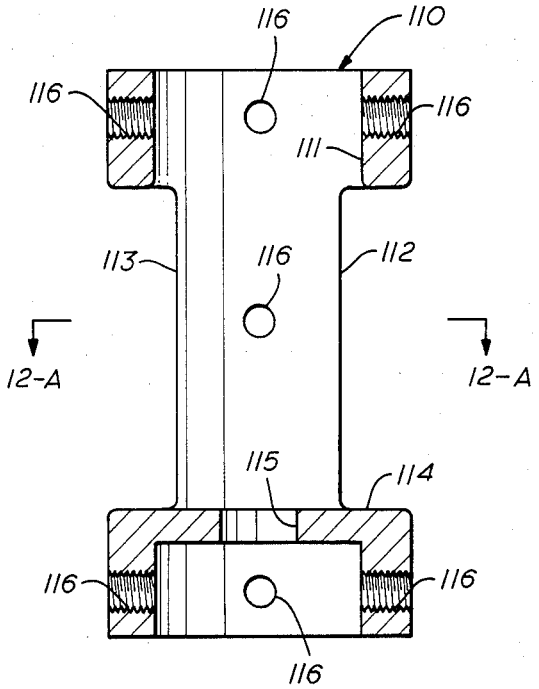
FIG. 12
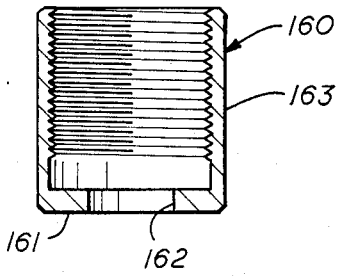
FIG. 13

ELECTRIC PUMP

This application is continuation in part of prior copending application Ser. No. 777,709 entitled "PUMP" filed on Sept. 11, 1985.

BACKGROUND OF THE INVENTION

The injection of chemicals in order to enhance the production of hydrocarbon products from a well, has long been practiced. Many types of pumps have been used. It is desirable to provide a discreet amount of chemical, withdrawn from a source, at regular intervals, to a production well. Obviously other operations than production wells may have such needs. Various problems have occurred. Applicants' prior copending application dealt with the prevention of contamination of or by the injection fluid, by using 2-way seals around a reciprocating plunger. A particular problem addressed by this invention, is the excessive amount of energy necessary to cause pump plunger reciprocation, and the excessive wear, and thereby cost of operation. Applicants have attempted to solve this problem by providing a low friction mechanism for reciprocating said plunger.

SUMMARY OF THE INVENTION

An electric motor, through a gear box, rotates a pump input shaft. Said shaft carries an eccentrically mounted cam. The cam, in turn, carries a ball bearing assembly around its periphery. Injection fluid is withdrawn from a source into a valve reservoir by the suction action caused by the intake stroke of a reciprocating plunger. Likewise, such fluid is ejected from the reservoir toward the end use, such as a production well, by the exhaust stroke of such plunger. Such reciprocation is caused by said rotating cam's bearing assembly pressing against an end of said plunger. Such intimate relationship is assured by said plunger being spring urged in the direction of the cam.

DESCRIPTION OF THE DRAWINGS

FIG. 1 is a perspective of the pump, as related to an electric motor and gear box;

FIG. 3 is an end elevation of the housing and pumphead end fitting and FIG. 3-A is a section taken along lines 3-A—3-A of FIG. 3;

FIG. 4 is a broken top elevation of the housing, with cover plate removed;

FIGS. 7-A, 7-B are respectively a front elevation and a vertical axial section of a front bearing mounting plate;

FIGS. 8-A, 8-B are respectively a front elevation and vertical axial section of a rear bearing mounting plate;

FIG. 9 is a side elevation of the pump input shaft;

FIG. 9-A is an end elevation of the shaft of FIG. 9;

FIG. 10 is a rear elevation of the cam;

FIG. 10-A is a section taken along line 10-A—10-A of FIG. 10;

FIG. 11 is an end view of the headmounting adapter, while FIG. 11-A is a sectional view thereof taken along lines 11-A—11-A of FIG. 11;

FIG. 12 is a vertical axial section of FIG. 12-A while FIG. 12-A is a sectional view taken along lines 12-A—12-A of FIG. 12;

FIG. 13 is an axial section through the collet;

DESCRIPTION OF A PREFERRED EMBODIMENT

Figure 2:
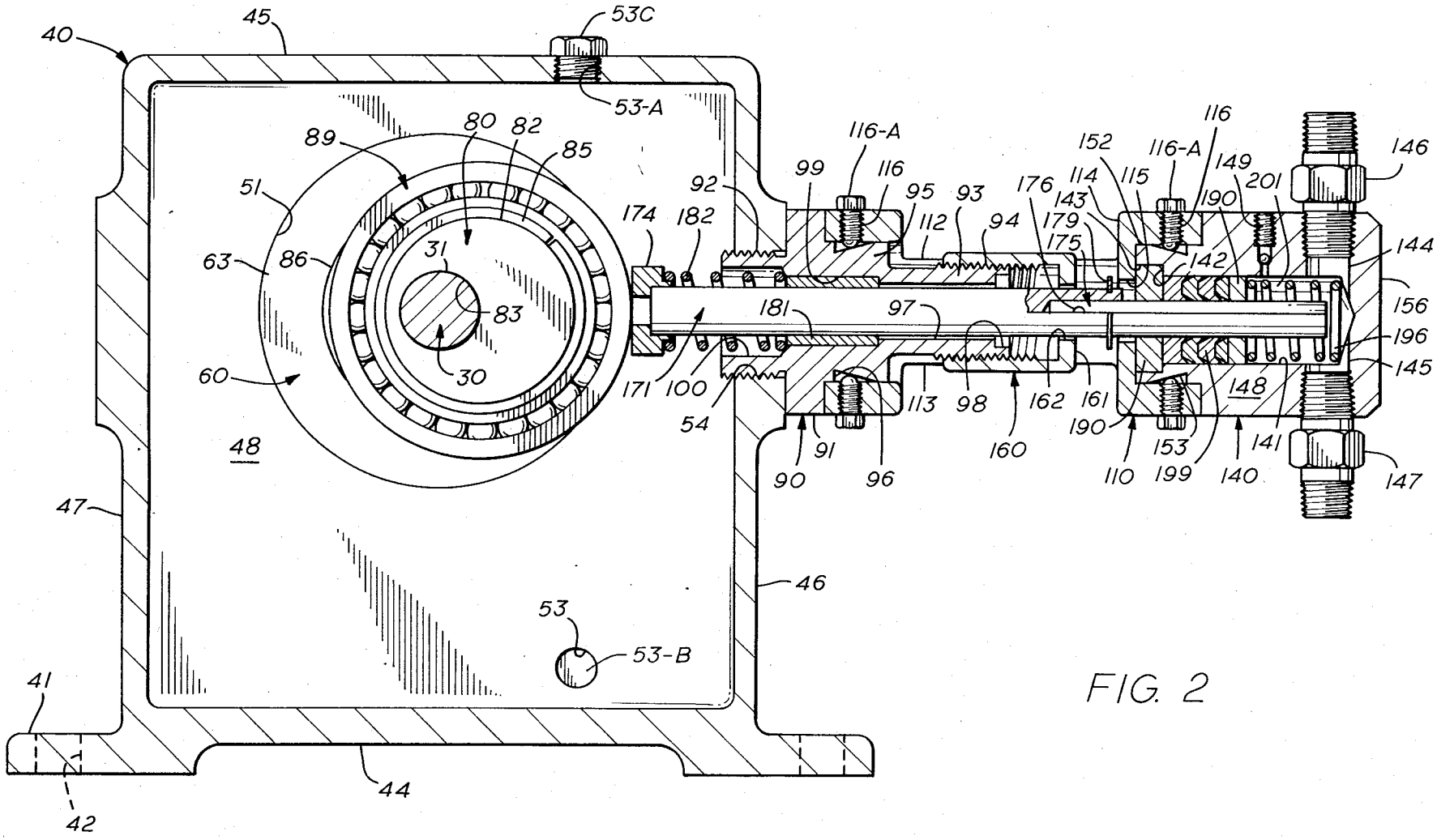
FIG. 2 is a rear elevation of pumphousing and pumphead, with the housing's rear cover plate removed, and the head shown in vertical section.
Figure 6:
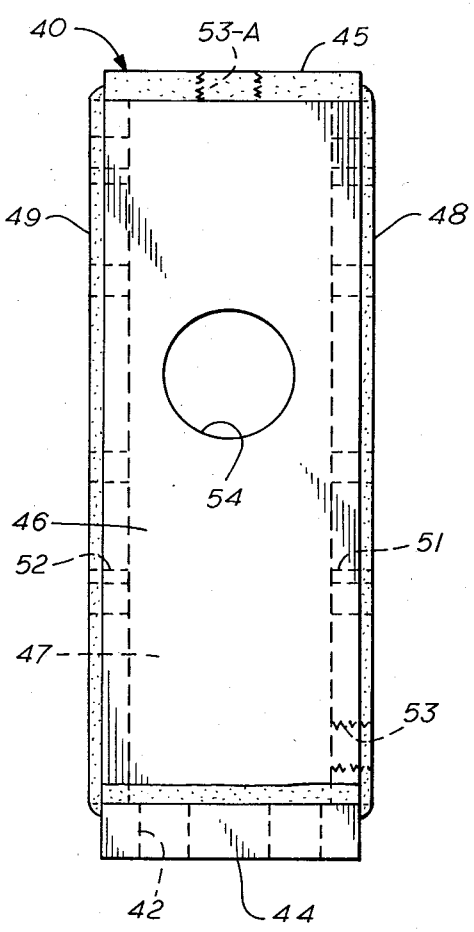
FIGS. 5 and 6, respectively are rear and end elevations of the pumphousing.
Figure 5:
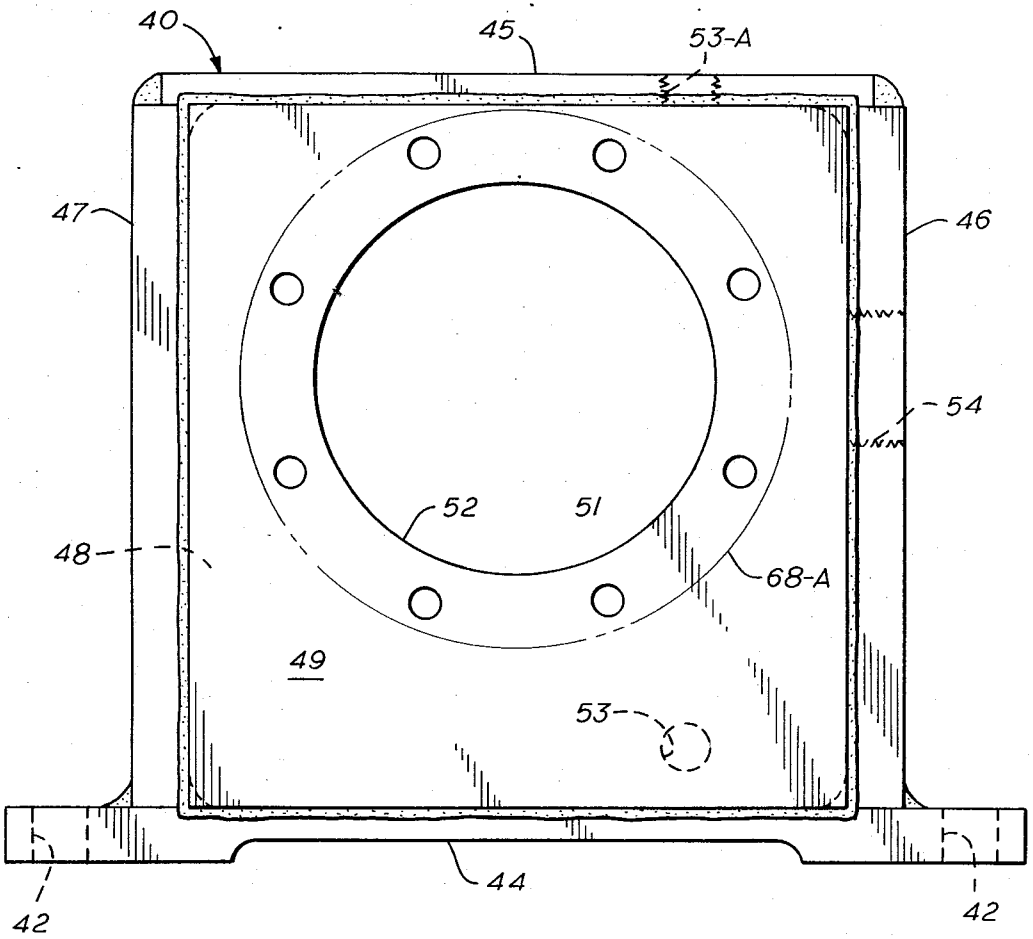

FIG. 1 generally indicates an electric motor 10 which, through intermediate gear box 11, rotates input shaft 30 (later described) of pump 20. The linkage between gear box 11 and pump input shaft 30 may be a shaft to collar to shaft, for example, but is not specifically illustrated, in that per se use of an electric motor to rotate a shaft through an intermediate gear box, is not new. Pumphousing 40 is secured to flanges 41, which may be anchored to a skid by bolts 42-B passing through apertures 42.

Pumphousing 40 includes bottom and cover plates 44,45, as well as end plates 46,47 and front and rear plates 48,49. Said front and rear plates are approximately centrally apertured at 51,52 respectively, so as to receive front and rear bearing mounting plates 60,67. Said front cover plate 48 is also apertured at 53, forming an oil drain which may be closed by a plug, 53-B. End plate 46 is threadedly apertured at 54 to receive the pumphead, later described. Cover plate 45 is threadedly apertured at 53-A, forming an oil fill, which may be closed by a plug, 53-C. The housing interior may be filled with oil.

Cylindrical mounting plate 60 includes an annular front face 61 with a plurality of bolt receiving, apertures 62 around its periphery for securing said plate, by bolts 62-A, to housing front plate or wall 48. Gasket material 61-A may be provided therebetween. Skirt 63 depends from member 61 and includes bore 64, and dead-end counterbore 65 communicating therewith by virtue of shoulder 66.

Rear mounting plate 67 includes an annular front face 68 with a plurality of bolt receiving apertures 69 around its periphery for securing said plate, by bolts 69-A, to housing rear plate or wall 49. Front face 68 of mounting plate 67 is centrally apertured at 71. Skirt 72 depends from member 68 and includes bore 73 and counterbore 74. Said counterbore 74 communicates with bore 73 by shoulder 76, and with aperture 71 by shoulder 77.

Pump input shaft 30 is cylindrical in configuration and includes enlarged body 31, with chamfered nose 32 depending from one end thereof. Reduced diameter portion 33 depends from the other end of body 31, and further reduced chamfered tail 34 depends from portion 33. Tail 34 includes keyway 35. A motor controlled output shaft (not shown) would be linked to shaft 30, keyed to keyway 35, through gear box 11, in a conventional manner, thereby rotating shaft 30.

Cam 80 includes annular face 81 having depending cylindrical skirt 82. Axially eccentric bore 83 extends through said face and skirt. Annular cut-out 84 receives locking ring 85. Cam 80 is eccentrically mounted (as by welding) on shaft 30. Annular ball bearing assemblies 86,87 conventionally having inner and outer races rotatably receive shaft nose 32 and shaft reduced portion 33, annular seal 88 preventing leakage from the interior of pumphousing 40. Cam 80 carries ball bearing assembly 89 around its periphery, secured thereto by lip 81-A of face 81 and locking ring 85.

Consider now the pumphead and its components. Mounting adapter 90, especially see FIGS. 11 and 11-A, includes an integral hex-head nut 91 forming the central portion. An exteriorly threaded nose 92 depends from said nut portion and engages the interiorly threaded aperture 54 of pumphousing end plate 46. Tail portion 93 is exteriorly threaded at 94, said tail portion being linked to nut 91 by cylindrical connector portion 95. The said connector portion is annularly cut away at 96. Extending axially through mounting adapter 90, are a series of communicating bores and counterbores, namely bore 97, seal-receiving counterbore 98, bushing receiving counterbore 99 and spring seat counterbore 100. Said seal and bushing are illustrated in FIG. 2.

Outboard of nut portion 91, is hollow cylindrical head spacer 110. This member includes an axial bore 111. The axial bore is restricted by web 114 which has further axial bore 115 therethrough. The spacer also includes elongated apertures 112,113 through the spacer's cylindrical walls. Annularly spaced about the ends and middle of spacer 110 are a plurality of threaded taps 116, for receiving set screws 116-A to secure the spacer to the mounting adapter 90 and to the pumphead end fitting 140, described hereinafter.

Further outboard from pump housing 40 is said pumphead end fitting 140 (see FIGS. 3 and 3-A). This cylindrical member includes chamfered end wall 156, dead-end axial bore 141 communicating at one end with counterbore 143 by virtue of shoulder 142. Said dead-end creates reservoir 201 for injection fluid. Opposed, threaded, injection-fluid inlet and outlet 144,145 communicate with said bore 141, at the dead end thereof. Threaded male fittings 146,147 having ball check valves therein for unidirectional fluid flow, communicate respectively with a supply of injection fluid and a well or other end use, in which such fluid is to be injected. Also communicating with bore 141, through the wall of end fittings central housing 148 of end fitting 140, is a threaded radial tap 149 and communicating bore 151 to receive a check valve mechanism, only generally shown in FIG. 2, to relieve pressure build up within reservoir 201 of bore 141. Nipple extension 152 depends from the end fitting's central housing 148, said extension containing counterbore 143. The outer annular wall of the nipple extension is annularly recessed at 153 to receive set screws passing through threaded taps 116, thereby securing said end fitting to said spacer.110.

Collet or collar 160 (see FIG. 13) includes web 161, perforated at 162, with internally threaded, depending skirt 163. The outer skirt surface is knurled, for hand-gripping purposes. The inner skirt threads adjustably engage threads 94 of the adapter tail section. A user has access to this adjustment device, through apertures 112,113. Rotating such collar 16 moves it axially along fixed adapter 90, thereby controlling the stroke length of the plunger, hereafter described. FIG. 2 illustrates a very limited plunger stroke. By virtue of retainer ring 179, secured to plunger portion 171, the stroke length is limited to the axial distance between collet web 161 and the adjacent spacer web 114.

Figure 14:
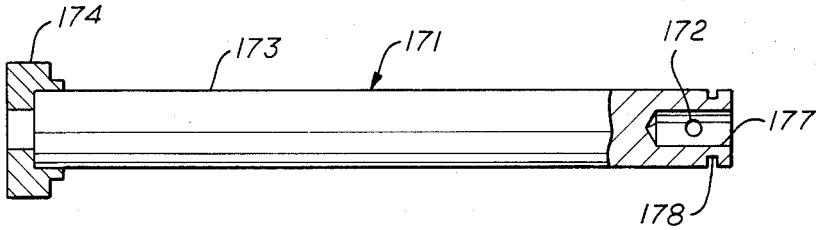
FIG. 14 is a partly broken away, elevation of the plunger base.
Figure 15:
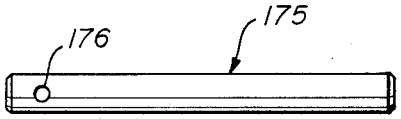
FIG. 15 is a front elevation of the plunger stem.
Figure 16:
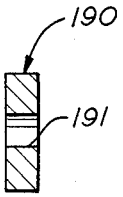
FIG. 16 is an axial section through the back-up washer.

The plunger (see FIGS. 14 and 15), shown in FIG. 2, is of two part construction and includes plunger base, or power plunger 171 which is roll pin connected to plunger stem 175 through their respective pin-receiving apertures 172, 176. Stem 175 is simply a cylindrical rod, with chamfered ends. Power plunger 171 includes a cylindrical body 173, having a head 174 secured to one end thereof, and a socket 177 internally formed in its other end. Power plunger aperture 172 actually passes through the wall of body 173, surrounding said socket. The end of plunger stem 175, adjacent aperture 176 would be urged within base socket 177, have apertures 172,176 aligned, whereon they would be pin connected, for unitary action. For certain situations, having a requirement for a larger diameter plunger, a single, unitary plunger may be used. FIG. 2 indicates such alternative possibility by only partially depicting stem 175. Similarly, the diameter of aperture 115 may vary. Finally, the diameter of aperture 191 through washers 190 may variably accommodate differently sized plungers as illustrated. Annular slot 178 extends around body 173, to receive retainer ring 179.

Bushing 181 would be positioned within counterbore 99. Coil spring 182 is seated against both said fixed bushing and head 174, thereby urging the plunger toward shaft 30, ie., to the left in FIG. 2.

Coil spring 196 would seat against the dead end of bore 141 as well as against the nearest of washers 190. Chevron or "V" packing 199 encircles the plunger stem, and is kept compressed between washers 190 by the pressure of spring 196.

In operation, electric motor 10, through gear box 11, would rotate input shaft 30, in a conventional manner. Rotation of shaft 30 would cause rotation of eccentric cam 80, secured to said shaft. Cam 80 carriers ball bearing assembly 89 annularly therearound. Power plunger head 174 is continuously urged toward said bearing assembly 89 by spring 182. As shown in FIG. 2, the plunger is urged to its optimum exhaust stroke by cam 80, exhausting injection fluid from reservoir 201, through outlet 147, toward its objective. Conversely, when cam 80 is rotated 180 degrees, the plunger reaches it optimum suction stroke, drawing injection fluid from its source.

Numerous obvious benefits appear from the foregoing description. These include [1] modular construction of the pumphead, [2] friction reduction, with resultant decrease in both wear and tear and power loss, resulting from the ball bearing linkage between the cam and plunger, and [3] the ease of stroke adjustability by virtue of the knurled collar and access thereto.

Figure 17:
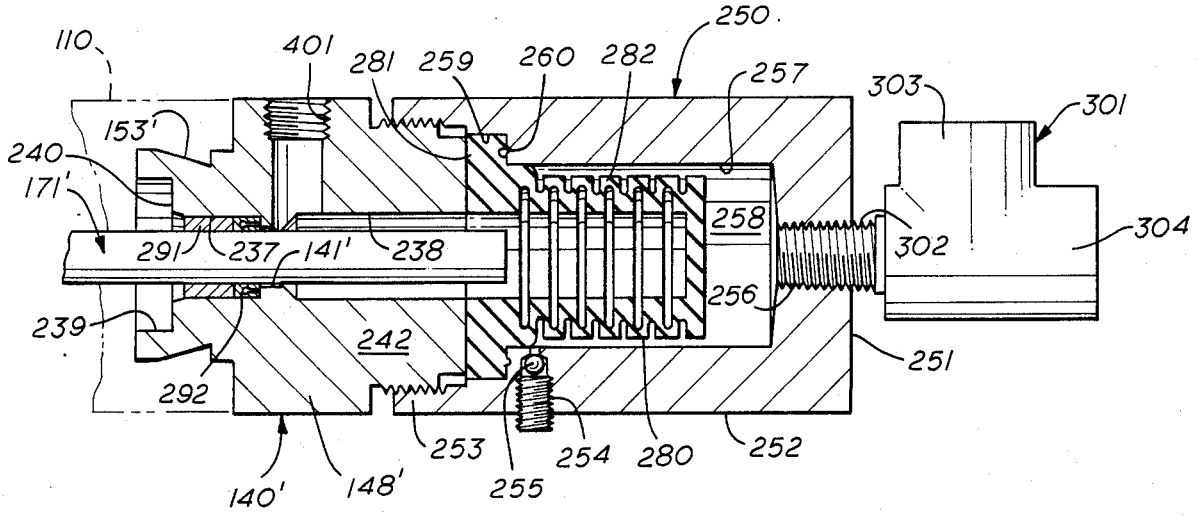
FIG. 17 is a vertical axial section of the connector, used to permit bellows operation, as connected with the bellows housing.

In the event it is desirable to use the bellows arrangement of my copending application, entitled "PUMP" filed during September, 1985, the connector of FIG. 17 would be substituted for end fitting 140, as follows. Connector 140' (see FIG. 17) would be positioned immediately outboard of adapter 110 in place of end fitting 140 which would be removed along with washers 190 and chevron packing 199. This cylindrical member 140' includes central housing 148', depending lip 241 and exteriorly threaded tail 242, axial bore 141' and opposed counterbores 237 and 238, the former being in communication with further counterbore 239 by virtue of shoulder 240. Annular recess 153' receives the set screws passing through apertures 116, to link the connector with spacer 110. The said tail threads permit engagement with bellows housing 250, as described in said prior copending application. Interiorly threaded reservoir fluid inlet 401 communicates with bore 141' and counterbore 238. A plug seal (not shown) may be provided. Counterbore 237 receives bushing 291 and double acting seal 292.

Bellows housing 250 is cup-shaped and includes web 251, depending skirt 252, interiorly threaded depending lip 253, bleed port 254, with ball check valve 255 provided therein, and injection fluid passageway 256. An interior bore 257 and counterbore 259, defines a reservoir for injection fluid 258 therein. Said bore 257 and counterbore 259 are joined by shoulder 260. Bellows 280 includes axially hollow flange 281 and hollow skirt 282. Said flange 281 is positioned intermediate bellows housing shoulder 260 and the adjacent end of connector 140'.

T-configured exterior fitting 301 includes a threaded connection 302 engaging passageway 256, as well as injection fluid inlet and outlet 303, 304, these latter members would include check valves to permit only unidirectional fluid flow.

This embodiment's operation, like that of the copending application; comprises plunger 171' entering the hollow interior of bellows 280 during the exhaust stroke, and withdrawing therefrom during the suction stroke. Like said prior application, 2-way seal 292 prevents fluid leakage in either direction.

Although limited embodiments have been described, it should be obvious that numerous modifications would be possible by one skilled in the art without departing from the spirit of the invention, the scope of which is limited only by the following claims.

We claim:

1. An injection pump having an input shaft capable of being rotated by an outside source of power, said pump comprising:

housing member rotatably receiving said input shaft, said shaft having a cam eccentrically mounted thereon, said housing positioning ball bearing assembly means on opposite sides of said cam, for rotatably supporting said shaft, said cam carrying a further ball bearing assembly means around its periphery, said housing also including pumphead receiving means extending through a wall of said housing;

pumphead means in communication with said further ball bearing assembly means, said pumphead means including;

mounting means adapted to be received by said pumphead receiving means, said mounting means being axially bored and carrying means within said bore for (1) reciprocatingly receiving a plunger and (2) receiving spring means for biasing said plunger toward said cam, spacer means removably secured to both said mounting means and to an injection fluid reservoir means, said spacer means being axially bored for receiving said plunger and further having aperture means for permitting access to an adjustment collar, said adjustment collar including means which, in conjunction with said spacer means, adjusts the stroke of said plunger, said injection fluid reservoir means being axially bored for receiving said plunger, said reservoir means including injection fluid inlet and outlet communicating with a reservoir portion, and reciprocating plunger means in contact, at one end thereof, with said further ball bearing assembly means, its other end being reciprocatingly received by said reservoir portion of said reservoir means, said plunger further carrying means limiting said plungers stroke to the linear separation between one end of said adjustment collar and an adjacent web of said spacer.

2. The pump of claim 1 and including means for varying the effective diameter of said other plunger end.

* * * * *